United States Patent [19]

Kukes et al.

[11] Patent Number: 4,797,196

[45] Date of Patent: Jan. 10, 1989

[54] HYDROCRACKING PROCESS USING SPECIAL JUXTAPOSITION OF CATALYST ZONES

[75] Inventors: Simon G. Kukes, Naperville; L. Charles Gutberlet, Wheaton, both of Ill.; Albert L. Hensley, Jr., Munster, Ind.

[73] Assignee: Amoco Corporation, Chicago, Ill.

[21] Appl. No.: 160,680

[22] Filed: Feb. 26, 1988

[51] Int. Cl.[4] ..... C10G 65/10

[52] U.S. Cl. ..... 208/59; 208/111; 208/112; 208/210; 502/314; 502/315; 502/335; 502/337; 502/439; 502/64; 502/79

[58] Field of Search ..... 208/59, 111, 89, 210, 208/112; 502/66, 73, 84, 305, 314, 315, 335, 64, 337, 439, 79

[56] References Cited

U.S. PATENT DOCUMENTS

| | | | |
|---|---|---|---|
| 3,026,260 | 3/1962 | Watkins | 208/59 |
| 3,563,886 | 2/1971 | Carlson et al. | 208/210 |
| 3,617,486 | 11/1971 | Lewis et al. | 208/111 |
| 3,725,251 | 4/1973 | Alpert et al. | 208/210 |
| 3,796,655 | 3/1974 | Armistead et al. | 208/146 |
| 3,809,644 | 5/1974 | Johnson et al. | 208/210 |
| 3,857,780 | 12/1974 | Gustafson | 208/139 |
| 3,963,600 | 6/1976 | Hilfman | 208/59 |
| 4,017,382 | 4/1977 | Bonnell et al. | 208/210 |
| 4,421,633 | 12/1983 | Shih et al. | 208/89 |
| 4,500,415 | 2/1985 | Simo et al. | 208/59 |
| 4,517,073 | 5/1985 | Ward et al. | 502/66 |
| 4,563,434 | 1/1986 | Ward et al. | 502/66 |
| 4,576,711 | 3/1986 | Ward et al. | 502/74 |
| 4,619,759 | 10/1986 | Myers et al. | 208/210 |
| 4,657,663 | 4/1987 | Gardner et al. | 208/210 |

*Primary Examiner*—Anthony McFarlane

*Attorney, Agent, or Firm*—Ekkehard Schoettle; William H. Magidson; Ralph C. Medhurst

[57] ABSTRACT

Disclosed is a hydrocracking process wherein the feedstock is first contacted with a first catalyst containing a nickel component and a tungsten component supported on a support containing alumina and a crystalline molecular sieve followed by subsequent contact with a second hydrocracking catalyst containing a cobalt component and a molybdenum component supported on a support containing silica-alumina and a crystalline molecular sieve and the first catalyst. This subsequent contact with the second and first catalysts is carried out either serially or in one step wherein the first and second catalysts are physically mixed.

19 Claims, No Drawings

HYDROCRACKING PROCESS USING SPECIAL JUXTAPOSITION OF CATALYST ZONES

BACKGROUND OF THE INVENTION

The present invention relates to a hydrocarbon conversion process. More particularly, this invention relates to the catalytic hydrocracking of hydrocarbons.

The hydrocracking of hydrocarbons is old and well-known in the prior art. These hydrocracking processes can be used to hydrocrack various hydrocarbon fractions such as reduced crudes, gas oils, heavy gas oils, topped crudes, shale oil, coal extract and tar extract wherein these fractions may or may not contain nitrogen compounds. Modern hydrocracking processes were developed primarily to process feeds having a high content of polycyclic aromatic compounds, which are relatively unreactive in catalytic cracking. The hydrocracking process is used to produce desirable products such as turbine fuel, diesel fuel, and middle distillate products such as naphtha and gasoline.

The hydrocracking process is generally carried out in any suitable reaction vessel under elevated temperatures and pressures in the presence of hydrogen and a hydrocracking catalyst so as to yield a product containing the desired distribution of hydrocarbon products Hydrocracking catalysts generally comprise a hydrogenation component on an acidic cracking support. More specifically, hydrocracking catalysts comprise a hydrogenation componett selected from the group consisting of Group VIB metals and or Group VIII metals of the Periodic Table of Elements, their oxides or sulfides. The prior art has also taught that these hydrocracking catalysts contain an acidic support comprising a crystalline aluminosilicate material such as X-type and Y-type aluminosilicate materials. This crystalline aluminosilicate material is generally suspended in a refractory inorganic oxide such as silica, alumina, or silica-alumina.

Regarding the hydrogenation component the preferred Group VIB metals are tungsten and molybdenum; the preferred Group VIII metals are nickel and cobalt. The prior art has also taught that combinations of metals for the hydrogenation component, expressed as oxides and in the order of preference, are: $NiO-WO_3$, $NiO-MoO_3$, $CoO-MoO_3$, and $CoO-WO_3$. Other hydrogenation components broadly taught by the prior art include iron, ruthenium, rhodium, palladium, osmium, indium, platinum, chromium, vanadium, niobium, and tantalum.

References that disclose hydrocracking catalysts utilizing nickel and tungsten as hydrogenation components, teach enhanced hydrocracking activity when the matrix or catalyst support contains silica-alumina. For instance, U.S. Pat. Nos. 4,576,711, 4,563,434, and 4,517,073 all to Ward et al., show at Table V thereof that the lowest hydrocracking activity is achieved when alumina is used in the support instead of a dispersion of silica-alumina in alumina. The lowest hydrocracking activity is indicated by the highest reactor temperature required to achieve 60 vol. % conversion of the hydrocarbon components boiling above a predetermining end point to below that end point.

Similarly, U.S. Pat. No. 3,536,605 to Kittrell et al. teaches the use of silica-alumina in the catalyst support when a nickel- and tungsten-containing hydrogenation component is employed.

U.S. Pat. No. 3,598,719 to White teaches a hydrocracking catalyst that can contain 0 wt. % silica, i.e. less than 15 wt. % silica. All of the examples, however, show the presence of silica and there is no disclosure of a catalyst containing an alumina matrix when the hydrogenation metals are specifically nickel and tungsten.

As can be appreciated from the above, there is a myriad of catalysts or catalyst systems known for hydrocracking whose properties vary widely. A catalyst suitable for maximizing naphtha yield may not be suitable for maximizing the yield of turbine fuel or distillate. Further, the various reactions; i.e., denitrogenation, hydrogenation, and hydrocracking must be reconciled in a hydrocracking process in an optimum manner to achieve the desired results.

For instance when a feedstock having a high nitrogen content is exposed to a hydrocracking catalyst containing a high amount of cracking component the nitrogen serves to poison or deactivate the cracking component. Thus, hydrodenitrogenation catalysts do not possess a high cracking activity since they are generally devoid of a cracking component that is capable of being poisoned. Another difficulty is presented when the hydrocracking process is used to maximize naphtha yields from a feedstock containing light catalytic cycle oil which has a very high aromatics content. The saturation properties of the catalyst must be carefully gauged to saturate only one aromatic ring of a polynuclear aromatic compound such as naphthalene in order to preserve desirable high octane value aromatic-containing hydrocarbons for the naphtha fraction. If the saturation activity is too high, all of the aromatic rings will be saturated and subsequently cracked to lower octane value paraffins.

On the other hand, distillate fuels such as diesel fuel or aviation fuel have specifications that stipulate a low aromatics content. This is due to the undesirable smoke production caused by the combustion of aromatics in diesel engines and jet engines.

Prior art processes designed to convert high nitrogen content feedstocks are usually two stage processes wherein the first stage is designed to convert organic nitrogen compounds to ammonia prior to contacting with a hydrocracking catalyst which contained a high amount of cracking component; e.g., a molecular sieve material.

For instance U.S. Pat. No. 3,923,638 to Bertolacini et al., discloses a two catalyst process suitable for converting a hydrocarbon containing substantial amounts of nitrogen to saturated products adequate for use as jet fuel. Specifically, the subject patent discloses a process wherein the hydrodenitrogenation catalyst comprises as a hydrogenation component a Group VIB metal and Group VIII metal and/or their compounds and a cocatalytic acidic support comprising a large-pore crystalline aluminosilicate material and refractory inorganic oxide. The hydrocracking catalyst comprises as a hydrogenation component a Group VIB metal and a Group VIII metal and/or their compounds, and an acidic support of large-pore crystalline aluminosilicate material. For both hydrodenitrogenation catalyst and the hydrocracking catalyst, the preferred hydrogenation component comprises nickel and tungsten and/or their compounds and the preferred large-pore crystalline aluminosilicate material is ultrastable, large-pore crystalline aluminosilicate material.

In accordance with the present invention it has been discovered that the naphtha yield of a hydrocracking process can be markedly increased by employing a plurality of reaction zones in series wherein each zone contains a particular catalyst and when these catalysts are juxtaposed in the zones in an essential order. Specifically, it has been discovered that even if the same volumes or weights of particular catalysts are used in the zones of a hydrocracking process, if the zones are not juxtaposed in accordance with the present invention the increased naphtha yield will not be afforded.

An attendant advantage of the process of the present invention is an increase in overall catalyst activity.

SUMMARY OF THE INVENTION

This invention relates to a process for hydrocracking a hydrocarbon feedstock with hydrogen at hydrocracking conversion conditions in a plurality of reaction zones in series. Specifically, the feedstock is contacted in a first reaction zone with a first hydrocracking catalyst comprising a nickel component and a tungsten component deposed on a upport component consisting essentially of an alumina component and a crystalline molecular sieve component. The effluent from the first reaction zone is then passed to a second reaction zone and contacted with a second hydrocracking catalyst comprising a cobalt component and a molybdenum component deposed on a support component comprising a silica-alumina component and a crystalline molecular sieve component. The effluent from the second reaction zone is then contacted in a third reaction zone with the above-described first hydrocracking catalyst.

In another embodiment of the present invention, the second reaction zone contains a physical or mechanical mixture of the first and second hydrocracking catalysts obviating the presence of a third reaction zone.

DETAILED DESCRIPTION OF THE INVENTION

The hydrocarbon charge stock subject to hydrocracking in accordance with the process of this invention is suitably selected from the group consisting of petroleum distillates, solvent deasphalted petroleum residua, shale oils and coal tar distillates. These feedstocks typically have a boiling range above about 200° F. and generally have a boiling range between 350° to 950° F. More specifically these feedstocks include heavy distillates, heavy straight-run gas oils and heavy cracked cycle oils, as well as fluidized catalytic cracking unit feeds. The process of the invention is especially suitable in connection with handling feeds that include a light catalytic cycle oil. This light catalytic cycle oil generally has a boiling range of about 350° to about 750° F., a sulfur content of about 0.3 to about 2.5 wt %, a nitrogen content of about 0.01 to about 0.15 wt % and an aromatics content of aout 40 to about 90 vol. %. The light catalytic cycle oil is a product of the fluidized catalytic cracking process.

Operating conditions to be used in each hydrocracking reaction zone of the present invention include an average catalyst bed temperature within the range of about 500° to 1000° F., preferably 600° to 900° F. and most preferably about 650° to about 850° F., a liquid hourly space velocity within the range of about 0.1 to about 10 volumes hydrocarbon per hour per volume catalyst, a total pressure within the range of about 500 psig to about 5,000 psig, and a hydrogen circulation rate of about 500 standard cubic feet to about 20,000 standard cubic feet per barrel.

The process of the present invention is carried out in a plurality of reaction zones wherein each reaction zone can comprise one or a plurality of catalyst beds. Each catalyst bed can have intrabed quench to control temperature rise due to the exothermic nature of the hydrocracking reactions. The charge stock may be a liquid, vapor, or liquid-vapor phase mixture, depending upon the temperature, pressure, proportion of hydrogen, and particular boiling range of the charge stock processed. The source of the hydrogen being admixed can comprise a hydrogen-rich gas stream obtained from a catalytic reforming unit.

In the first reaction zone of the present invention the denitrogenation and desulfurization reactions predominate resulting in the production of ammonia and hydrogen sulfide. In present invention, however, there is no removal of this ammonia and hydrogen sulfide by means of an intermediate separation step.

The hydrogenation component of the catalysts employed in the process of the invention comprise a Group VIB metal component and a Group VIII metal component. These components are typically present in the oxide or sulfide form.

The hydrogenation component of the first hydrocracking catalyst comprises nickel and tungsten and/or their compounds. The nickel and tungsten are present in the amounts specified below. These amounts are based on the total catalytic composite or catalyst weight and are calculated as the oxides, NiO and $WO_3$. In another embodiment of the present invention, the hydrogenation component can additionally comprise a phosphorus component. The amount of phosphorus component is calculated as $P_2O_5$ with the ranges thereof also set out below.

| | Broad | Preferred | Most Preferred |
|---|---|---|---|
| NiO, wt % | 1–10 | 1.5–5.0 | 1.5–4.0 |
| $WO_3$, wt % | 10–30 | 15–25 | 15–20 |
| $P_2O_5$, wt % | 0.0–10.0 | 0.0–6.0 | 0.0–3.0 |

Another component of the first hydrocracking catalytic composite or catalyst is the support. The support comprises a crystalline molecular sieve material and an alumina component. The preferred alumina is gamma alumina. The use of alumina in the first reaction zone catalyst support is in contradistinction to U.S. Pat. Nos. 4,576,711, 4,563,434, and 4,517,073 to Ward et al. and U.S. Pat. No. 3,536,605 to Kittrell et al. which require the presence of silica-alumina matrix material when nickel and tungsten are employed as hydrogenation components. Alumina is preferred because it increases hydrogenation activity. Hydrogenated reactants are hydrocracked at a faster rate in subsequent reaction zone(s) in accordance with the process of the present invention. The crystalline molecular sieve material is present in an amount ranging from about 10 to about 60 wt. %, preferably from about 25 to about 50 wt. % based upon the total weight of the support.

The hydrogenation component of the second hydrocracking catalyst of the present invention comprises cobalt and molybdenum and/or their compounds, these metals are present in the amounts specified below. These amounts are based on the total catalytic composite or catalyst weight and are calculated as the oxides CoO and $MoO_3$.

| | Broad | Preferred | Most Preferred |
|---|---|---|---|
| CoO, wt. % | 1–6 | 1.5–5 | 2–4 |
| $MoO_3$, wt. % | 3–20 | 6–15 | 8–12 |

Another component of the second hydrocracking catalyst is the support. The support comprises a crystalline molecular sieve material and a refractory inorganic oxide. The preferred refractory inorganic oxide is silica-alumina. Silica-alumina is preferred because its use results in a product having a higher iso to normal ratio for the pentane fraction of the product. The crystalline molecular sieve material is present in an amount ranging from about 10 to 60 wt. %, preferably from about 25 to about 50 based on total support weight.

In accordance with the invention, the third reaction zone contains the first hydrocracking catalyst described above. The improvement afforded by placing the first hydrocracking catalyst downstream of the second hydrocracking catalyst is surprising since the first hydrocracking catalyst possesses enhanced hydrogenation activity. As explained above, catalysts possessing hydrogenation activity are placed upstream of catalysts possessing hydrocracking activity since hydrogenated reactants are hydrocracked at a faster rate.

Preferably, in the first and second hydrocracking catalysts the crystalline molecular sieve material is distributed throughout and suspended in a porous matrix of the refractory inorganic oxide.

The hydrogenation component for each hydrocracking catalyst can be deposed upon the support by impregnation employing heat-decomposable salts of the above described metals or any other method well-known to those skilled in the art. Each of the metals can be impregnated onto the support separately, or they may be co-impregnated onto the support.

The support may be prepared by various wellknown methods and formed into pellets, beads, and extrudates of the desired size. For example, the crystalline molecular sieve material may be pulverized into finely divided material, and this latter material may be intimately admixed with the refractory inorganic oxide. The finely divided crystalline molecular sieve material may be admixed thoroughly with a hydrosol or hydrogel of the refractory inorganic oxide. Where a thoroughly blended hydrogel is obtained, this hydrogel may be dried and broken into pieces of desired shapes and sizes. The hydrogel may also be formed into small spherical particles by conventional spray drying techniques or equivalent means.

The molecular sieve materials of the invention preferably are selected from the group consisting of faujasite-type crystalline aluminosilicates, and mordenite-type crystalline aluminosilicates. Although not preferred, crystalline aluminosilicates such as ZSM-5, ZSM-11, ZSM-12, ZSM-23, and ZSM-35, and an AMS-1B crystalline molecular sieve can also be used with varying results alone or in combination with the faujasite-type or mordenite-type crystalline aluminosilicates. Examples of a faujasite-type crystalline aluminosilicate are high- and low-alkali metal Y-type crystalline aluminosilicates, metal-exchanged X-type and Y-type crystalline aluminosilicates, and ultrastable, large-pore crystalline aluminosilicate material. Zeolon is an example of a mordenite-type crystalline aluminosilicate.

Ultrastable, large-pore crystalline aluminosilicate material is represented by Z-14US zeolites which are described in U.S. Pat. Nos. 3,293,192 and 3,449,070. Each of these patents is incorporated by reference herein and made a part hereof. By large-pore material is meant a material that has pores which are sufficiently large to permit the passage thereinto of benzene molecules and larger molecules and the passage therefrom of reaction products. For use in petroleum hydrocarbon conversion processes, it is often preferred to employ a large-pore molecular sieve material having a pore size of at least 5 Å (0.5 nm) to 10 Å (1 nm).

The ultrastable, large-pore crystalline aluminosilicate material is stable to exposure to elevated temperatures. This stability at elevated temperatures is discussed in the aforementioned U.S. Pat. Nos. 3,293,192 and 3,449,070. It may be demonstrated by a surface area measurement after calcination at 1,725° F. In addition, the ultrastable, large-pore crystalline aluminosilicate material exhibits extremely good stability toward wetting, which is defined as the ability of a particular aluminosilicate material to retain surface area or nitrogen-adsorption capacity after contact with water or water vapor. A sodium-form of the ultrastable, large-pore crystalline aluminosilicate material (about 2.15 wt % sodium) was shown to have a loss in nitrogen-absorption capacity that is less than 2% per wetting, when tested for stability to wetting by subjecting the material to a number of consecutive cycles, each cycle consisting of a wetting and a drying.

The ultrastable, large-pore crystalline aluminosilicate material that can be used for the catalytic composition of this invention exhibits a cubic unit cell dimension and hydroxyl infrared bands that distinguish it from other aluminosilicate materials. The cubic unit cell dimension of the preferred ultrastable, large-pore crystalline aluminosilicate is within the range of about 24.20 Angstrom units (Å) to about 24.55 Å. The hydroxyl infrared bands obtained with the preferred ultrastable, large-pore crystalline aluminosilicate material are a band near 3,745 $cm^{-1}$ (3,745±5 $cm^{-1}$), a band near 3,695 $cm^{-1}$ (3,690±10 $cm^{-1}$), and a band near 3,625 $cm^{-1}$ (3,690±5 $cm^{-1}$). The band near 3,745 $cm^{-1}$ may be found on many of the hydrogen-form and decationized aluminosilicate materials, but the band near 3,695 $cm^{-1}$ and the band near 3,625 $cm^{-1}$ are characteristic of the preferred ultrastable, large-pore crystalline aluminosilicate material that is used in the catalyst of the present invention.

The ultrastable, large-pore crystalline aluminosilicate material is characterized also by an alkaline metal content of less than 1%.

Another example of a crystalline molecular sieve zeolite that can be employed in the catalytic composition of the present invention is a metal-exchanged Y-type molecular sieve. Y-type zeolitic molecular sieves are discussed in U.S. Pat. No. 3,130,007. The metal-exchanged Y-type molecular sieve can be prepared by replacing the original cation associated with the molecular sieve by a variety of other cations according to techniques that are known in the art. Ion exchange techniques have been disclosed in many patents, several of which are U.S. Pat. Nos. 3,140,249, 3,140,251, and 3,140,253. Specifically, a mixture of rare earth metals can be exchanged into a Y-type zeolitic molecular sieve and such rare earth metal-exchanged Y-type molecular sieve can be employed suitably in the catalytic composition of the present invention. Specific examples of suitable rare earth metals are cerium, lanthanum, and praseodymium.

As mentioned above, another zeolitic molecular sieve material that can be used in the catalytic composition of the present invention is ZSM-5 crystalline zeolitic molecular sieves. Descriptions of the ZSM-5 composition and its method of preparation are presented by Argauer, et al., in U.S. Pat. No. 3,702,886. This patent is incorporated by reference herein and made a part hereof.

An additional molecular sieve that can be used in the catalytic compositions of the present invention is AMS-1B crystalline borosilicate, which is described in U.S. Pat. No. 4,269,813, which patent is incorporated by reference herein and made a part thereof.

A suitable AMS-1B crystalline borosilicate is a molecular sieve material having the following composition in terms of mole ratios of oxides:

$$0.9\pm0.2M_{2/n}O:B_2O_3:YSiO_2:ZH_2O,$$

wherein M is at least one cation having a valence of n, Y is within the range of 4 to about 600, and Z is within the range of 0 to about 160, and providing an X-ray diffraction pattern comprising the following X-ray diffraction lines and assigned strengths:

| d(Å) | Assigned Strength |
|---|---|
| 11.2 ± 0.2 | W-VS |
| 10.0 ± 0.2 | W-MS |
| 5.97 ± 0.07 | W-M |
| 3.82 ± 0.05 | VS |
| 3.70 ± 0.05 | MS |
| 3.62 ± 0.05 | M-MS |
| 2.97 ± 0.02 | W-M |
| 1.99 ± 0.02 | VW-M |

Mordenite-type crystalline aluminosilicates can be employed in the catalyst of the present invention. Mordenite-type crystalline aluminosilicate zeolites have been discussed in patent art, e.g., by Kimberlin in U.S. Pat. No. 3,247,098, by Benesi, et al., in U.S. Pat. No. 3,281,483, and by Adams, et al., in U.S. Pat. No. 3,299,153. Those portions of each of these patents which portions are directed to mordenite-type aluminosilicates are incorporated by reference and made a part hereof.

In accordance with the process of the invention, the preferred amounts of catalyst in each respective zone are set out below as a percentage range of the overall amount of catalyst used in the process.

| | Broad | Preferred |
|---|---|---|
| Zone 1 | 25–45 | 30–40 |
| Zone 2 | 30–50 | 35–45 |
| Zone 3 | 15–35 | 20–30 |

In another aspect of the present invention, the first and second hydrocracking catalysts are both present in the second reaction zone in a mechanically or physically mixed state. The mechanical mixture contains about 10 to about 60 wt. % first hydrocracking catalyst and preferably about 30 to about 50 wt. %. In this embodiment of the present invention, the amount of catalyst in the second reaction zone as a percentage of the overall amount of catalyst used in the process ranges from about 30 to about 50 wt. %, and preferably from about 35 to about 45 wt. %.

The catalysts used in the present invention can be used in any form such as pellets, spheres, extrudates, or other shapes having particular cross sections such as a clover leaf, or "C" shape.

In a preferred embodiment of the present invention the catalyst situated at the downstream portion of the plurality of reaction zones possesses a small nominal size while the remaining upstream portion of catalyst possesses a large nominal size greater than the small nominal size catalyst. Specifically, the small nominal size is defined as catalyst particles having a U.S. sieve mesh size ranging from about 10 to about 16; preferably from about 10 to about 12. The large nominal size catalyst preferably ranges from about 5 to about 7 U.S. sieve mesh size. Further details of this preferred embodiment are disclosed in Ser. No. 160,524, filed on even date, the teachings of which are incorporated by reference.

Generally, the small nominal size hydrocracking catalyst is present in an amount ranging from about 5 to 70 wt % of the total overall amount of catalyst used in this invention. Preferably this amount ranges from about 10 to about 60 wt %. The amount of small nominal size hydrocracking catalyst used in the process of the invention can be limited in accordance with the desired overall pressure gradient. This amount can be readily calculated by those skilled in the art as explained in U.S. Pat. Nos. 3,796,655 (Armistead) and 3,563,886 (Carlson et al.).

The present invention is described in further detail in connection with the following examples, it being understood that these are presented for purposes of illustration and not limitation.

EXAMPLE I

The process of the invention was compared with an alternative process utilizing the same amount and type of catalyst as prescribed by the present invention, however, not in accordance with the prescribed invention juxtaposition of catalysts.

Specifically, the process of the invention was tested in a reactor having catalyst beds loaded as set out below:

| | wt. g. | catalyst | zone |
|---|---|---|---|
| beds 1 and 2 | 9.79 | NiW/Al—USY | 1 |
| beds 3 and 4 | 11.63 | CoMo/SiAl—USY | 2 |
| bed 5 | 6.53 | NiW/Al—USY | 3 |

The comparative process was carried out in a reactor loaded as set out below:

| | wt. g. | catalyst | zone |
|---|---|---|---|
| beds 1–3 | 16.32 | NiW/Al—USY | 1 |
| beds 4 and 5 | 11.63 | CoMo/SiAl—USY | 2 |

The comparative process and the process in accordance with the invention were used to convert a light catalytic cycle oil feedstock to naphtha and distillate products. Each catalyst was contacted with the feedstock at conversion conditions for at least a week before data was taken. The reaction conditions were adjusted such that 77 vol. % of the feed boiling above 380° F. was hydrocracked to material having a boiling range less than 380° F. These reaction conditions included a pressure of 1250 psig, a liquid hourly space velocity of 1.42 WHSV and a hydrogen circulation rate of 12,000 SCFB.

Table 1 below sets out the properties of the light catalytic cycle oil feedstock used in each test run.

TABLE 1

| Feed Properties | |
|---|---|
| API gravity | 21.9 |
| C, % | 89.58 |
| H, % | 10.37 |
| S, % | 0.55 |
| N, ppm | 485 |
| Total aromatics, wt % | 69.5 |
| Polyaromatics, wt % | 42.2 |
| Simulated distillation, °F. | |
| IBP, wt % | 321 |
| 10 | 409 |
| 25 | 453 |
| 50 | 521 |
| 75 | 594 |
| 90 | 643 |
| FBP | 756 |

The following Table 2 sets out the composition of each catalyst used in the present example to convert the feed described in Table 1.

TABLE 2

| PROPERTIES OF CATALYSTS | NiW/Al/USY | CoMo/SiAl/USY |
|---|---|---|
| Chemical Composition, wt % | | |
| $MoO_3$ | | 10.55 |
| $WO_3$ | 17.78 | — |
| NiO | 1.90 | — |
| CoO | — | 2.5 |
| $Na_2O$ | .13 | .07 |
| $SO_4$ | .29 | .13 |
| Support Composition, wt % | | |
| silica | | |
| alumina | 65 | |
| silica-alumina | | |
| crystalline molecular | | 65 |
| sieve, USY | 35 | 35 |
| Surface Properties | | |
| S.A., $m^2/g$ | 350 | 384 |
| Unit Cell Size | 24.51 | 24.52 |
| Crystallinity, % | 94 | 110 |
| Physical Properties | | |
| Density, $lbs/st^3$ | 49.7 | 45.5 |
| Crush Strength, lbs/mm | 7.4 | 4.5 |
| Abrasion Loss, wt % (1 hr) | 1.2 | .4 |
| Mesh Size (U.S. Sieve) | | |

Table 3 below sets out the product selectivities corrected to a common conversion and temperature, namely 77 wt % and 725° F. These corrected selectivities were calcualted from corrected yields. The method and equations used to calculate these "corrected" yields are set out in U.S. Pat. No. 3,923,638 (Bertolacini et al.), the teachings of which are incorporated by reference. The table also sets out the corrected catalyst activity, i.e., the reactor temperature required to effect the 77 wt. % conversion of the feedstock. These data were acquired on the 10th day of catalyst oil contact.

TABLE 3

| | Comparative | Invention |
|---|---|---|
| Dry Gas | 4.19 | 4.87 |
| Butane | 12.82 | 11.99 |
| Pentane | 11.31 | 11.00 |
| Light Naphtha | 17.63 | 17.24 |
| Heavy Naphtha | 56.25 | 57.90 |
| Activity, °F. | 720 | 717 |

The above table clearly shows that heavy naphtha yield can be increased by juxtaposing the reaction zones in accordance with the present invention and using the same amount and type of catalyst. Further, the process of the invention resulted in a higher overall catalyst activity.

EXAMPLE 2

The present example serves to elucidate another aspect of the present invention wherein the first and second reaction zone catalysts are physically mixed in a second reaction zone.

This aspect of the invention was compared with a comparative process that used the same weights or volumes of catalyst, however, not in accordance with the juxtaposition of catalysts prescribed by the present aspect of the invention.

The comparative test run was carried out with a reactor loaded in the same manner described in Example 1. The test run in accordance with the present aspect of the invention was carried out in a reactor loaded in the following fashion:

| | wt. g. | catalyst | zone |
|---|---|---|---|
| beds 1 and 2 | 9.79 | NiW/Al—USY | 1 |
| beds 3–5 | 6.53 | NiW/Al—USY | 2 |
| | 11.63 | CoMo/SiAl—USY | |

where the catalysts in beds 3 through 5 were physically or mechanically mixed.

The runs were carried out nder the same conditions set out in Example 1. After about 5.5 days on stream; in each case, the following selectivities were determined as corrected to 77 wt. % conversion and 725° F. The activity was corrected to 77 wt. % conversion. The activity data were acquired on the 10th day of catalyst-oil contact.

TABLE 4

| | Comparative | Invention |
|---|---|---|
| Dry Gas | 5.12 | 4.86 |
| Butane | 12.97 | 12.20 |
| Pentane | 11.35 | 10.96 |
| Light Naphtha | 17.77 | 17.24 |
| Heavy Naphtha | 55.82 | 57.75 |
| Activity, °F. | 720 | 717 |

From the above Table, it is clear that the process of the invention provides for a higher heavy naphtha yield and a superior overall activity notwithstanding the fact that the same amounts and types of catalysts as in the comparative process were used.

What is claimed is:

1. A process for hydrocracking a hydrocarbon feedstock with hydrogen at hydrocracking conversion conditions in a plurality of reaction zones in series which comprises:

a. contacting said feedstock in a first reaction zone with a first hydrocracking catalyst comprising a nickel component and a tungsten component deposed on a support component consisting essentially of an alumina component and a crystalline molecular sieve component;

b. contacting the effluent from said first reaction zone in a second reaction zone with a second hydrocracking catalyst comprising a cobalt component and a molybdenum component deposed on a support component comprising a silica-alumina component and a crystalline molecular sieve component.

c. contacting the effluent from said second reaction zone in a third reaction zone with said first hydrocracking catalyst.

2. The process of claim 1 wherein said crystalline molecular sieve component is a Y zeolite.

3. The process of claim 1 wherein said first hydrocracking catalyst contains said nickel in an amount ranging from about 1.5 to about 5.0 wt. % and said tungsten in an amount ranging from about 15 to about 25 wt. % both calculated as the oxides and based on the total weight of said first hydrocracking catalyst and wherein said second hydrocracking catalyst contains said cobalt in an amount ranging from about 1.5 to about 5 wt. % and said molybdenum in an amount ranging from about 6 to about 15 wt. % both calculated as oxides and based on the total weight of said second hydrocracking catalyst.

4. The process of claim 1 wherein a portion of the catalyst present in said plurality of reaction zones in series comprising said first, second, and third reaction zones contains catalyst having a small nominal particle size ranging from about 10 to about 16 U.S. Sieve mesh size and wherein the remaining catalyst located upstream of said small nominal particle size catalyst possesses a large nominal particle size greater than said small nominal particle size.

5. The process of claim 4 wherein said small nominal size catalyst possesses a particle size ranging from about 10 to about 12 U.S. Sieve mesh size and said large nominal particle size ranges from about 5 to about 7 U.S. Sieve mesh size.

6. The process of claim 4 wherein said small nominal size hydrocracking catalyst is present in an amount ranging from about 5 to about 70 wt. % based on the total amount of hydrocracking catalyst present in said plurality of reaction zones.

7. The process of claim 1 wherein said first hydrocracking catalyst contains said nickel in an amount ranging from about 1.5 to about 4 wt. % and said tungsten in an amount ranging from about 15 to about 20 wt. % both calculated as the oxides and based on the total weight of said first hydrocracking catalyst and wherein said second hydrocracking catalyst contains said cobalt in an amount ranging from about 2 to about 4 wt. % and said molybdenum in an amount ranging from about 8 to about 12 wt. % both calculated as oxides and based on the total weight of said second hydrocracking catalyst.

8. The process of claim 7 wherein said crystalline molecular sieve component is a Y zeolite.

9. The process of claim 7 wherein a portion of the catalyst present in said plurality of reaction zones in series comprising said first, second, and third reaction zones contains catalyst having a small nominal particle size ranging from about 10 to about 16 U.S. Sieve mesh size and wherein the remaining portion of catalyst located upstream of said small nominal particle size catalyst possesses a large nominal particle size greater than said small nominal particle size.

10. The process of claim 9 wherein said small nominal size catalyst possesses a particle size ranging from about 10 to about 12 U.S. Sieve mesh size and said large nominal particle size ranges from about 5 to about 7 U.S. Sieve mesh size.

11. The process of claim 9 wherein said small nominal size hydrocracking catalyst is present in an amount ranging from about 5 to about 70 wt. % based on the total amount of hydrocracking catalyst present in said plurality of reaction zones.

12. A process for hydrocracking a hydrocarbon feedstock with hydrogen at hydrocracking conversion conditions in a plurality of reaction zones in series which comprises:

a. contacting said feedstock in a first reaction zone with a first hydrocracking catalyst comprising a nickel component and a tungsten component deposed on a support consisting essentially of an alumina component and a crystalline molecular sieve component; and b. contacting the effluent from said first reaction zone in a second reaction with a physical mixture of said first hydrocracking catalyst and a second hydrocracking catalyst comprising a cobalt component and a molybdenum component deposed on a support component comprising a silica-alumina component and a crystalline molecular sieve component.

13. The process of claim 12 wherein said crystalline molecular sieve component is a Y zeolite.

14. The process of claim 12 wherein said first hydrocracking catalyst contains said nickel in an amount ranging from about 1.5 to about 5 wt. % and said tungsten in an amount ranging from about 15 to about 25 wt. % both calculated as the oxides and based on the total weight of first hydrocracking catalyst and wherein said second hydrocracking catalyst contains said cobalt in an amount ranging from about 1.5 to about 5 wt. % and said molybdenum in an amount ranging from about 6 to about 15 wt. % both calculated as oxides and based on the total second hydrocracking weight.

15. The process of claim 12 wherein a portion of the catalyst present in said plurality of reaction zones in series comprising said first and second reaction zones contains catalyst having a small nominal particle size ranging from about 10 to about 16 U.S. Sieve mesh size and wherein the remaining portion of catalyst located upstream of said small nominal particle size catalyst possesses a large nominal particle size greater than said small nominal particle size.

16. The process of claim 15 wherein said small nominal size catalyst possesses a particle size ranging from about 10 to about 12 U.S. Sieve mesh size and said large nominal particle size ranges from about 5 to about 7 U.S. Sieve mesh size.

17. The process of claim 15 wherein said small nominal size hydrocracking catalyst is present in an amount ranging from about 5 to about 70 wt. % based on the total amount of hydrocracking catalyst present in said plurality of reaction zones.

18. The process of claim 14 wherein said first hydrocracking catalyst contains said nickel in an amount ranging from about 1.5 to about 4.0 wt. % and said tungsten in an amount ranging from about 15 to about 20 wt. % both calculated as the oxides and based on the total weight of first hydrocracking catalyst and wherein said second hydrocracking catalyst contains said cobalt in an amount ranging from about 2 to about 4 wt. % and said molybdenum in an amount ranging from about 8 to about 12 wt. % both calculated as oxides and based on the total second hydrocracking weight.

19. The process of claim 14 wherein said crystalline molecular sieve component is a Y zeolite.

* * * * *